United States Patent [19]

Lindahl

[11] Patent Number: 4,776,926

[45] **Date of Patent: * Oct. 11, 1988**

[54] PROCESS FOR PRODUCING HIGH YIELD BLEACHED CELLULOSE PULP

[75] Inventor: Jonas A. Lindahl, Domsjo, Sweden

[73] Assignee: Mo och Domsjo AB, Ornskoldsvik, Sweden

[ * ] Notice: The portion of the term of this patent subsequent to Jan. 7, 2003 has been disclaimed.

[21] Appl. No.: 774,203

[22] Filed: Sep. 9, 1985

[30] Foreign Application Priority Data

Sep. 10, 1984 [SE] Sweden ..... 8404521

[51] Int. Cl.[4] ..... D21B 1/04; D21C 9/08

[52] U.S. Cl. ..... 162/28; 162/37; 162/41; 162/55

[58] Field of Search ..... 162/55, 57, 37, 40, 162/41, 28, 261, 19, 78; 241/28

[56] References Cited

U.S. PATENT DOCUMENTS

| | | | |
|---|---|---|---|
| 3,994,770 | 11/1976 | Lausch | 162/55 X |
| 4,087,316 | 5/1978 | Jividen et al. | 162/55 X |
| 4,462,864 | 7/1984 | Carles et al. | 162/41 X |
| 4,502,918 | 3/1985 | Mackie et al. | 162/55 X |
| 4,534,397 | 8/1985 | Norrström et al. | 162/28 X |
| 4,562,969 | 1/1986 | Lindahl | 241/21 |

*Primary Examiner*—Peter Chin
*Assistant Examiner*—Thi Dang

[57] ABSTRACT

A process is provided for producing high yield bleached cellulose pulp, such as groundwood pulp, thermomechanical pulp, chemimechanical pulp and waste paper pulp, having a broad field of use, which comprises bleaching cellulose pulp, thinning the pulp to a low pulp consistency; mechanically working the pulp; and fractionating the cellulose pulp into a long-fiber fraction and a fine-fiber fraction, the freeness of the long-fiber fraction exceeding the freeness of the fine-fiber fraction by from about 150 to about 600 ml C.S.F. and the fine-fiber fraction constituting from about 35 to about 70% by weight of the bleached pulp.

7 Claims, 2 Drawing Sheets

Fig. 1 PRIOR ART
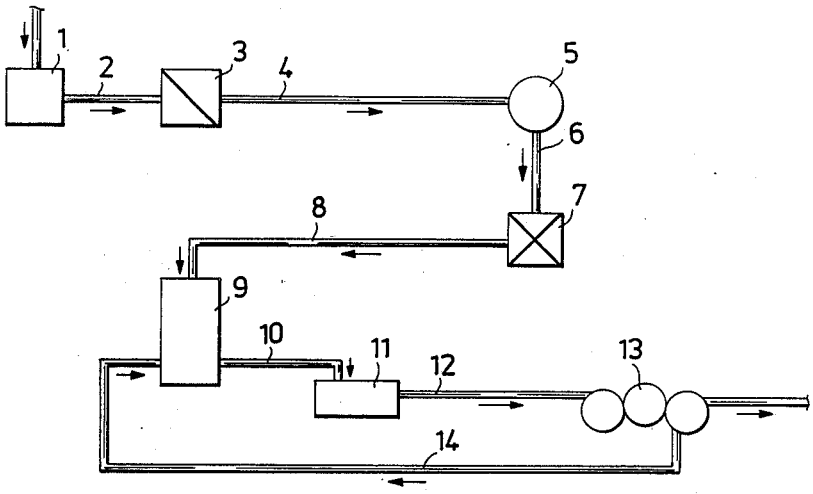
Fig. 2 INVENTION
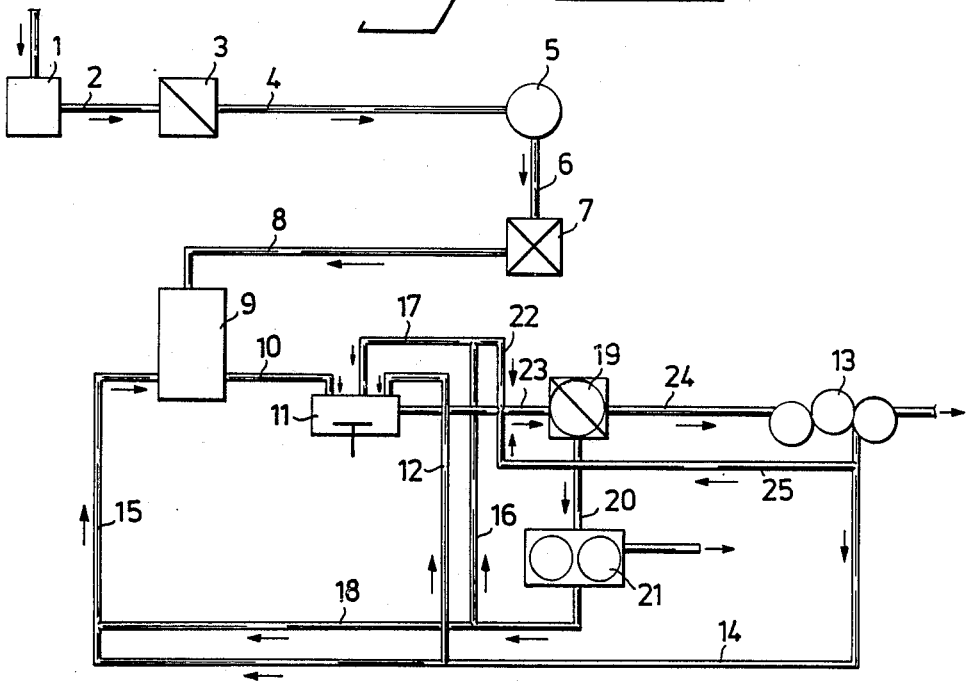

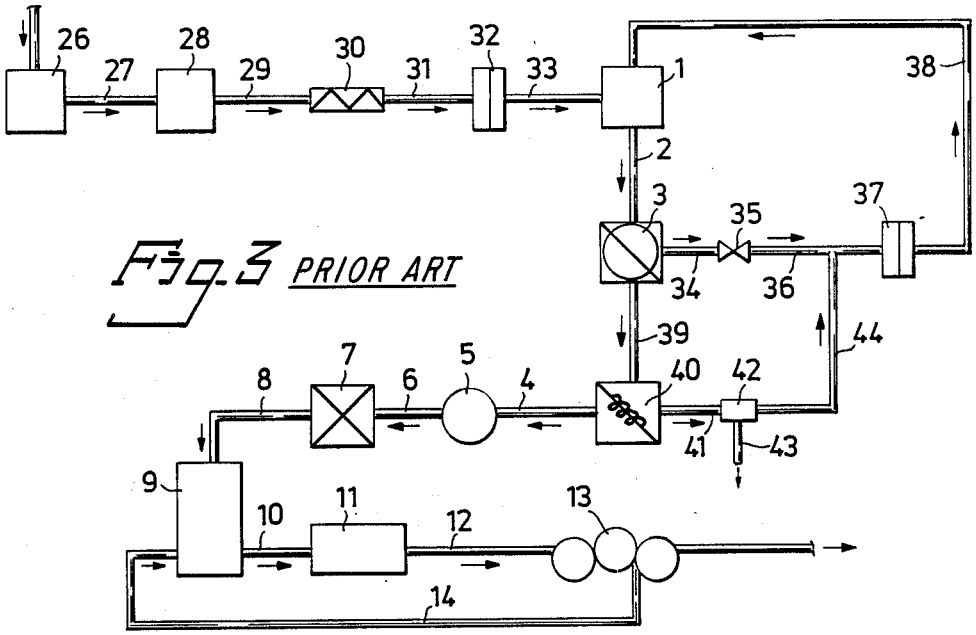
Fig. 3 PRIOR ART
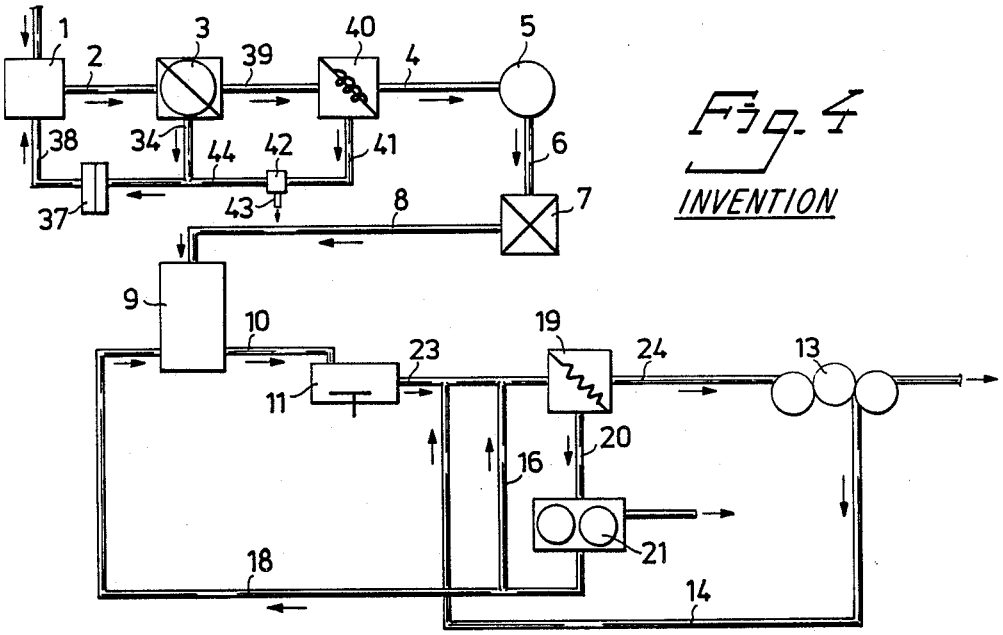
Fig. 4 INVENTION

PROCESS FOR PRODUCING HIGH YIELD BLEACHED CELLULOSE PULP

Groundwood pulp is produced by bringing logs or wood chips into contact with a rotating grindstone, saving the resultant fiber suspension through a coarse screen to remove coarse particles from the suspension, and then screening the accepts pulp from the coarse screen through a fine screen or series of fine screens.

In the production of chemimechanical pulp, wood chips are first impregnated with chemicals and heated to high temperatures, pre-cooking the wood chips to obtain a yield of between about 65% and about 95%, calculated on the weight of the wood. The chips then are defibrated in a disc refiner to form pulp fibers, which are normally refined in a further disc refiner for further defibration and processing. The resultant pulp, however, is not completely defibered, but still contains fiber nodules and shives (material which when screened in a laboratory screen will not pass through a screen plate having a slot width of 0.15 mm). In order to separate shives from pulp fibers, the pulp is thinned with large quantities of water, so that the pulp concentration in the resultant suspension normally is from about 0.5 to about 3%, and the suspension (the inject) is usually screened in a centrifugal screen, and separated into two parts. One part, the accepts, has a lower shives content than the inject, while the other part, the rejects, is enriched in shives. The accepts is passed through a vortex cleaner for further cleaning. The rejects obtained from the centrifugal screen and the vortex cleaners is passed to a disc refiner, and worked up to pulp fibers, which are normally passed back to the centrifugal screen. After bleaching, the accepts from the centrifugal screen and from the vortex cleaners is passed to a wet machine or paper machine.

Thermomechanical pulp is prepared from preheated chips that are defibrated in a similar manner, but in this case the chips are not treated with chemicals.

Waste paper pulp is produced by pulping newsprint, cardboard etc., screening and deinking the resultant pulp suspension, and optionally bleaching the pulp.

High yield pulps can be used for the manufacture of all types of products in which pulp fibers are an essential component. Examples of such products are absorbent products, paperboard, cardboard, newsprint, and other types of printing paper and soft paper. In the manufacture of printing paper, a low shives content is required, and the pulp must provide a paper of low surface roughness and high opacity. A serious problem with chemimechanical high yield pulps is the high surface roughness and relatively low opacity of the paper products produced therefrom. Chemithermomechanical pulp gives the same problem as normally obtained at yields of 92 to 95%. The consumption of electrical energy in the manufacture of chemithermomechanical pulp for printing paper is high. For example, the amount of electrical energy consumed in the manufacture of one ton of pulp with a drainability, measured as freeness, of about 100 ml Canadian Standard Freeness (CSF) may reach from 2 to 2.5 MWh. Chemithermomechanical pulp manufactured in one or more refiners gives a paper of lower surface quality than paper produced from chemical pulp and groundwood pulp, despite the high electrical energy input.

Groundwood pulp is normally used to produce newsprint, other types of printing paper and also soft paper, for which a low shives content is required. A high shives content causes breaks in the web during the paper manufacturing process, results in paper of high surface roughness, and gives rise to distrubances in printing. Consequently, a serious problem in manufacturing groundwood pulp is to obtain a low shives content. The pulp used for these products is therefore ground to a relatively low freeness, i.e. from 70 to 200 ml C.S.F.

Groundwood pulp can also be used to produce cardboard or paperboard, where a low shives content is also desired. Groundwood pulp used to produce cardboard or paperboard, however, should also have a relatively high freeness, i.e. from 250 to 400 ml C.S.F. One disadvantage in grinding wood to a high freeness, however, is that the shives content will be high, and the pulp relatively weak. Another disadvantage with groundwood pulp used to produce cardboard or paperboard is its high content of extractives (resin), which creates odors and flavor problems, inter alia, for the foodstuff industry.

In recent years, there has been developed a chemimechanical pulp which has a very high freeness, i.e. from 400 to 700 ml C.S.F., and also a low shives content. This pulp is well suited to the manufacture of absorbent products. However, modern techniques for producing stone groundwood pulp do not make it possible to produce a pulp useful for absorbent products to a freeness in excess of 500 ml C.S.F., because a pulp of such high freeness contains excessive quantities of extractives, and an insufficient number of freely exposed fibers, in addition to which most of the pulp comprises shives and splinters.

It is highly desirable that the properties of the aforesaid high yield pulps be improved, in order to broaden their field of use.

The present invention resolves these problems and provides a method for producing improved high yield pulp.

In accordance with the invention of Ser. No. 586,454 filed Mar. 5, 1984, a process is provided for preparing at a low energy consumption groundwood pulp as:

(i) a short-fiber fraction that is essentially shives free and has a low freeness, low surface roughness, and high opacity; and (ii) a long-fiber fraction that has a high freeness and a low resin content; which comprises the steps of:

(1) grinding lignocellulosic material to form an aqueous groundwood pulp fiber suspension;

(2) screening the groundwood pulp fiber suspension through a coarse screen having screen openings not less than about 5 mm;

(3) defibrating lignocellulosic material separated out on the coarse screen;

(4) recycling the defibrated lignocellulosic material to the groundwood pulp fiber suspension from the grinding step (1);

(5) separating the groundwood pulp fiber suspension from step (2) into (a) an accepts fraction and (b) a rejects fraction, the latter comprising from about 30% up to about 85% by weight of the fiber suspension;

(6) screening the rejects fraction 5(b) of the groundwood pulp fiber suspension through a screen having screen openings of less than about 5 mm;

(7) separating the fiber suspension from step (6) into (a) an accepts fraction and (b) a rejects fraction;

(8) recycling the rejects fraction 7(b) to the defibrating step (3) and then to the groundwood pulp fiber suspension from the grinding step (1);

(9) screening the accepts fraction 7(a) to form (a) a short-fiber accepts fraction of which from about 15 to about 60% comprises fibers passing through a sieve No. 150 in a Bauer-McNett classifier, and (b) a long-fiber rejects fraction of which at least 80% comprises long fibers retained on a sieve No. 150 in a Bauer-McNett classifier;

(10) withdrawing the long-fiber rejects fraction 9(b) as groundwood pulp product (ii).

(11) blending the short-fiber accepts fraction 9(a) with accepts fraction 5(a); and

(12) withdrawing the resulting blend as short-fiber accepts fraction groundwood pulp product (i).

In accordance with the invention of Ser. No. 703,240 filed Feb. 20, 1985, a process is provided for preparing improved high-yield cellulose pulps of the chemimechanical or chemithermomechanical type, which comprises screening defibrated cellulose pulp in a first screening stage; separating out at least 30% by weight of the fiber content of the defibrated pulp as a first long-fiber fraction; and also separating out a further portion of the fiber content as a first fine-fiber fraction; screening the first fine-fiber fraction in a second screening stage and separating out a second long-fiber fraction and a second fine-fiber fraction; combining the first and the second long-fiber fractions to form an improved long-fiber fraction; dewatering and recovering the long-fiber fraction; dewatering the second fine-fiber fraction and recovering the second fine-fiber fraction.

In the process of the invention, after bleaching the pulp, and thinning it to a low pulp consistency, with vigorous agitation to break up the fiber flocs present, the pulp is fractionated into a long-fiber fraction and a fine-fiber fraction, the freeness according to SCAN-C21: 65 for the long-fiber fraction exceeding the freeness of the fine-fiber fraction by from about 150 to about 600 ml, and the fine-fiber fraction comprises from about 35 to about 70% by weight of the pulp after bleaching.

In the process of the invention, a bright high-yield pulp is obtained at a low energy consumption. This pulp is substantially free from shives, and is suitable for the manufacture, for example, of light weight coated paper (LWC paper) and for admixture with other high grade printing paper pulps. The term "high yield pulp" in the specification and claims encompasses any kind of pulp produced by mechanical defibration such as groundwood pulp, thermomechanical pulp, chemimechanical pulp, chemithermomechanical pulp, and mechanical pulp, produced with a yield of over 60%, and waste paper pulp.

The long-fiber fraction, which is produced at very low electrical energy consumption, has a low content of extractives (resin), a high freeness, from about 200 to about 700 ml C.S.F., and is highly suited for use, either alone or in admixture with other pulp, in the manufacture of absorbent products of high purity, high bulk, good absorption rates, and high absorption capacity.

A long-fiber fraction having a freeness of from about 300 to about 500 ml C.S.F. is particularly suited for the manufacture or cardboard of paperboard.

A pulp which is suitable for manufacture of soft paper can be produced by mixing the long and short fiber fractions together in varying proportions.

The properties of the pulp that is obtained can be adjusted by mixing either or both the pulp fractions with pulp which has not been fractionated. This produces pulps whose properties lie on an extraordinarily uniform level.

Corresponding advantages are obtained when treating waste paper pulp in accordance with the invention.

In the drawings:

FIG. 1 represents a flow sheet for the manufacture of bleached high yield pulp in accordance with the prior art, including both groundwood pulp and chemimechanical pulp;

FIG. 2 represents a flow sheet similar to FIG. 1 employing the process of the invention;

FIG. 3 represents a flow sheet for the manufacture of chemithermomechanical pulp in accordance with the known prior art; and FIG. 4 represents a flow sheet similar to FIG. 3 employing the process of the invention.

In the manufacture of high yield pulp in accordance with the prior art, as illustrated in FIG. 1, the fiber suspension is collected in a vessel 1 prior to separating out the shives in a screen room 3, after which they are passed through the line 2.

This system applies generally to high yield pulps, and it does not matter if the pulp is produced directly from logs by stone grinding processes, or if the pulp is produced from wood chips defibrated in a disc refiner.

After the screening 3, the pulp suspension is normally thickened to a pulp consistency (pc) of from 3 to 50% in a thickener 5, to which the pulp is passed through the line 4. If the pulp is to be bleached, for example with hydrogen peroxide, the pulp suspension is normally thickened to at least 10% pc. In modern bleaching plants, the pulp consistency may even be as high as 40%. When bleaching the pulp with a reducing bleaching agent, such as sodium dithionite or zinc dithionite, a pulp consistency of 3 to 6% is preferred.

The pulp next passes from the thickener through the line 6 to a mixer 7, where bleaching chemicals are mixed with the pulp. The pulp with the bleaching chemicals is passed through line 8 to a bleaching tower 9. If the pulp is bleached at a pulp consistency in excess of about 8%, the pulp is thinned to a pulp consistency of from 3 to 5% in the bottom of the bleaching tower.

The bleached pulp is normally then passed to an intermediate storage 11 through a conduit 10, prior to being pumped to a wet machine or paper machine 13 through the line 12. Most of the surplus liquid obtained from the wet machine is returned to the bleaching tower, through the line 14.

When producing high yield pulp, for example, groundwood pulp, thermomechanical and chemimechanical pulp, in accordance with the invention, as illustrated in FIG. 2, the pulp suspension obtained in the manufacture of the pulp is collected in the vessel 1, prior to separating shives and other impurities from the pulp in the screen room 3. The shives content of the screened pulp can be higher than in the process of the prior art. For example, the shives content of the screened pulp can be from 50 to 500% greater than that of the prior art screened pulp produced in accordance with known techniques, i.e. from 0.05 to 0.30% by weight.

After screening, the pulp suspension is thickened to a pulp consistency of from 3 to 50% in the thickener 5. Bleaching chemicals are mixed with the pulp in the mixer 7, and the resultant mixture then passed to the bleaching tower 9 through the line 8.

The pulp is transported from the bleaching tower, for example with the aid of screw conveyors, through the conduit 10 to the collecting vessel 11, and mixed therein with hot process water, which is supplied through the line 12. This process water is obtained when dewatering the fine-fiber fraction on the wet machine 13. Quantities of the same process water are used to thin the pulp in the bottom zone of the bleaching tower 9, being passed thereto through the lines 14 and 15. Hot process water is also introduced to the vessel 11 through the lines 16 and 17.

Quantities of this process water are also passed, when necessary, to the bottom zone of the bleaching tower 9, through the lines 18 and 15. This process water is obtained when dewatering the long-fiber fraction obtained from a fractionating apparatus 19 in a wet machine or dewatering device 21.

The process water should be maintained at a temperature within the range from about 40° to about 99° C. The amount of fine material present should be less than 300 mg/l, so as not to return excessively large quantities of fine material to the fractionating apparatus 19.

The pulp suspension in the vessel 11 is vigorously agitated by means of an agitating device, so as to break up mechanically the fiber flocs present. In order to obtain optimum results when subsequently fractionating the pulp into two fractions, it is extremely important to break up all fiber bundles and fiber flocs at this stage.

This mechanical treatment has been found most effective at a pulp consistency of from 3 to 7%. It is preferred to first treat the fiber suspension at a pulp consistency of 3 to 7% and then thin the pulp suspension with process water through lines 22 and 25 immediately prior to passing the pulp to the fractionating apparatus 19 through a conduit 23. The consistency of the pulp entering the fractionating apparatus 19 is from 0.3 to 4%.

The fractionating apparatus 19 can be a curved screen, a centrifugal screen, or a filter of suitable type. In accordance with the invention, at least 35 percent by weight of the ingoing pulp is fractionated into a fine-fiber fraction, this fraction being removed through line 24. The freeness of this fine-fiber fraction is maintained within the range from about 40 to about 175 ml C.S.F. The shives content according to Sommerville (slot width 0.15 mm) is within the range of from 0 to 0.07%. This fiber fraction is passed to the wet machine or paper machine 13 through line 24. This fine-fiber fraction contains at least 30% fibers which in a Bauer McNett classifier pass through a 150 mesh wire screen. A fine-fiber fraction of this fiber composition will produce a printing paper of low roughness, which results in uniform ink absorption and high opacity, in comparison with printing paper produced from known high yield pulps.

The long-fiber fraction from the fractionating apparatus 19 is passed through line 20 to the wet machine 21, and water separated there is carried away through line 18. The long-fiber fraction may also be passed to a disc refiner or to a screw defibrator for gentle mechanical working of the pulp fibers.

The long-fiber fraction in the line 20 has a high freeness from 200 to 750 ml C.S.F. and a low extractives content, less than 0.3% DKM, and comprises from 85 to 100% of fibers retained on a 150 mesh wire screen in a Bauer McNett fiber classifier. The properties of the long-fiber fraction render it highly suitable for use in the manufacture of absorbent products, and this fraction provides high bulk, good absorption rates and an extremely high absorption capacity. Thus, when practicing the method proposed in accordance with the invention, it is possible to produce, instead of a single bleached high yield pulp, at least two products, each having extremely good properties, at a low energy consumption, since the total energy consumed in respect of the long-fiber fraction in line 20 is, in accordance with the invention, 100 to 600 kWh/ton dry pulp, while corresponding values in respect, for example, of chemimechanical CTMP-type pulp are about 1000 kWh/ton of dry pulp. When producing the fine-fiber fraction in line 24, the energy consumed is from 1800 to 2000 kWh for each ton of dry pulp produced, while corresponding values in respect, for example, of CTMP are about 2300 kWh per ton of dry pulp produced. The long-fiber fraction produced in accordance with the invention is particularly suitable for admixture with other pulps, such as sulphite pulp and sulphate pulp. It is also highly suited to the manufacture of paperboard or cardboard and to the manufacture of absorbent products. The long-fiber frraction may also be admixed with other fiber material, such as recycle fibers, peat fibers and synthetic fibers.

The Examples represent preferred embodiments of the invention:

EXAMPLE 1

This Example illustrates the application of the invention when producing a chemithermomechanical pulp in a pilot plant (see FIG. 4), in comparison to the prior art (see FIG. 3).

Ten tons of chemimechanical spruce pulp was produced, and transported to the plants of FIGS. 3 and 4 for screening, bleaching and fractionation.

Spruce chips 30 to 50 mm long, 10 to 20 mm wide and 1 to 2 mm thick were transported to the impregnation chamber 26 (see FIG. 3) by means of a screw conveyor. The chamber was filled with sulphite solution having a pH of 7.2. The sulphite solution contained 5 g/l sulphur dioxide and 6.5 g/l sodium hydroxide. During the impregnation the chips absorbed an average 1.1 liters of sulphite solution for each kilogram of dry chips. The sulphur dioxide content thus was $1.1 \times 5 = 5.5$ g for each kilogram of chips, or 0.55%. The impregnation chamber 26 was maintained at a temperature of 130° C., and the total dwell time of the chips therein was about 2 minutes. During this dwell time, a weak sulphonation of the wood material was obtained.

The impregnated chips were passed to the cooker 28 through line 27, saturated steam being supplied to bring the chips to 130° C. The chip dwell time in the cooker was 5 minutes. Thus, when added to the dwell time in the impregnating chamber 26, the total sulphonation time was 7 minutes. The chips were fed from the bottom of the cooker 28 via line 29, conveyor screw 30 and line 31 to the disc refiner 32, where the chips were defibrated and refined to finished pulp.

The energy input to the disc refiner was 1900 kWh per ton of bone dry pulp produced.

The defibrated pulp was blown through line 33 into a cyclone (not shown in the Figure) in order to separate surplus steam from the pulp fibers. The pulp fibers were collected in carts and emptied into trucks, which then transported the pulp to a plant for further processing.

Upon arrival at the plant, the pulp was tipped into a vessel 1 provided with agitating means, a pulper, where the pulp was thinned with water to a pulp consistency of 1.2%. Measurements showed that the pulp freeness was 160 ml C.S.F. The resultant fiber suspension was passed via line 2 to pressure screen 3, provided with a fixed cylindrical screen basket, the fiber suspension being introduced into the screen basket under superatmospheric pressure. The screen was provided internally with a rotating and pulsating scraper means. The apertures in the perforated screen plates of the pressure screen had a diameter of 2.1 mm. The flow of fiber suspension to the pressure screen was controlled so that 16% by weight of the fiber content of the ingoing fiber suspension remained on the screen plates, and was discharged as rejects pulp through line 34, valve 35 and line 36 to a disc refiner 37, for further processing.

The pulp treated in the disc refiner was led back to the pulper 1 via line 38. The accepts obtained from the pressure screen 3 had a pulp consistency of 0.95%, and was removed via line 39 to vortex cleaners 40. The accepts pulp from the vortex cleaners was passed via line 4 to thickener 5. The rejects obtained from the vortex cleaners 40, this rejects corresponding to 10% of the ingoing pulp, was cleaned in further vortex cleaners (not shown in the Figure) to remove undesirable impurities, such as sand and splinters, which were separated out and passed via line 41 to separating apparatus 42, where the impurities were ejected through line 43. Cleaned rejects pulp obtained from the vortex cleaners was passed via line 44 to the rejects refiner 37.

Thickened pulp from the thickener 5 was passed through line 6 to mixer 7, in which the pulp was mixed with an aqueous 3% $H_2O_2$ solution containing 5% sodium silicate and 2% sodium hydroxide. The pulp had been blended upstream of the thickener 5 with 0.2% of a chelating agent, diethylene triamine pentaacetic acid (DTPA). The pulp was then passed through line 8 to bleaching tower 9.

After about two hours bleaching time, the pulp was thinned in the tower from 30% pc to 4% pc. The thinning liquid was introduced through line 14, and comprised surplus water from the wet machine 13. The pulp was taken out from the bottom of the bleaching tower, through line 10, and passed to a collecting vessel 11, from where it was passed to the wet machine 13 through line 12. A sample, designated Sample A, was taken from the bleached pulp, to determine, inter alia, its freeness, fiber composition, paper properties, and its properties in absorbent products.

Another portion of the spruce chips processed in the system of FIG. 3, for comparison, was then processed in accordance with the invention in the manner illustrated in FIG. 4. The units 26 to 32 are not needed, in the system of FIG. 4, and the pulp enters the container 1 directly. In this modification, the energy input to the disc refiner 32 (FIG. 3) was reduced from 1900 kWh/ton pulp to only 950 kWh/ton. The result was a coarse pulp having a freeness of 580 ml C.S.F.

This pulp was then transported to the plant of FIG. 4 for further processing in accordance with the invention, and charged to the vessel 1, a pulper. The pulp suspension having a pulp consistency of 0.95% was passed from the pulper 1 to the pressure screen 3 through line 2. The rejects pulp was passed via line 34 to the disc refiner 37, and the refined pulp was passed via line 38 back to the pulper. The accepts pulp obtained in the pressure screen 3 was passed to the vortex cleaners 40, through line 39. The consistency of the accepts pulp in line 4 was 0.70%.

Accepts pulp from the vortex cleaners was passed through line 4 to the thickener 5, bringing the pulp to a pulp consistency of 30%. Thickened pulp was then led through line 6 to the mixer 7, where the pulp was mixed with an aqueous 3% $H_2O_2$ solution containing 5% sodium silicate, 0.05% $MgSO_4$ and 2% NaOH. A chelating agent (DTPA) in an amount of 0.2% was added to the pulp upstream of the thickener. The pulp was then passed through line 8 to the bleaching tower 9.

After a dwell time of about 2 hours in the tower, the pulp consistency in the bottom zone of the tower was reduced from 28% to 5% by dilution with water obtained from a wet machine 21 and passed through line 18.

After being thinned, the pulp suspension was fed through line 10 to the vessel or vat 11, where the pulp was vigorously treated mechanically by means of an agitator at a temperature of 72° C. The energy input was measured at 12 kWh/ton. After about 3 minutes, the pulp suspension was pumped through line 23 to a curved screen 19, which was provided with slots having a width of 2.0 mm. In order to achieve the best possible separation across the curved screen, the pulp suspension was thinned immediately downstream of the vessel 11 to a pulp consistency of 1.1%, using process water obtained from lines 14 and 16.

During passage through the curved screen, 40% by weight of the pulp suspension passed through the slots of the screen and was collected on a wet machine 13. This fraction is designated the fine-fiber fraction.

The remainder of the pulp, i.e. 60% of the amount of ingoing pulp, was dewatered on the wet machine 21 to a dry solids content of 48%. This pulp is designated the long-fiber fraction.

Samples were taken from the two fractions, the fine-fiber fraction being designated Sample B, and the long-fiber fraction Sample C.

A further run was carried out with CTMP pulp produced in accordance with the prior art process of FIG. 3. This passed through line 23 to the curved screen 19 (FIG. 4) immediately after bleaching and thinning to 3% pc. The amount of fine-fiber fraction was in this case only 27% of the amount of ingoing pulp. The fine-fiber fraction was sampled, and the samples taken were designated Sample D. The long-fiber fraction in the line 20 was also sampled, and samples hereof designated Sample E. Both samples were analyzed.

The results of the analyses are shown in Tables I to III.

TABLE I

| | Sample | | | | |
|---|---|---|---|---|---|
| | A | B | C | D | E |
| Starting pulp freeness CSF, ml[1] | 130 | 580 | 580 | 160 | 160 |
| Sample freeness CSF, ml | 130 | 100 | 635 | 35 | 300 |
| Sample percent of starting pulp, % by weight | 100 | 40 | 60 | 27 | 72 |
| Shives content, Sommerville, % | 0.06 | 0.01 | 0.25 | 0.01 | 0.08 |
| Fiber composition according to Bauer McNett[2] | | | | | |
| +20 mesh % | 40.1 | 21.0 | 60.1 | 7.5 | 50.1 |
| +150 mesh % | 33.1 | 42.5 | 30.3 | 13.8 | 39.9 |
| −150 mesh % | 26.8 | 36.5 | 9.6 | 78.7 | 10.0 |
| Brightness, ISO[3] | 77.1 | 77.8 | 75.2 | 77.0 | 76.8 |

[1]According to SCAN-C 21:65
[2]According to SCAN-M 6:69
[3]According to SCAN-C 11:75

As the data shows, it is possible when practicing the method according to the invention (Samples B and C) to produce bleached pulps of different properties, by separating a relatively coarse and bleached pulp in two streams. The possibility of obtaining 40% by weight fine-fiber fraction from a pulp having a high freeness (580 ml C.S.F.) is particularly surprising. This is to be compared with the 27% by weight obtained (Samples D and E) when fractionating the pulp with low freeness (130 ml, C.S.F.). In view of the fact that the low-freeness pulp contained far more fibers which passed the finest wire gauze in the Bauer McNett fiber classifier, the reverse should be true. The result obtained with the process according to the invention is probably due to the effective and complete disintegration of fiber bundles and fiber flocs, achieved prior to separating the pulp into the aforesaid two fractions.

Samples A, B, D and E were tested with respect to paper technical properties, and the results of these tests are shown in Table II.

TABLE II

| | Samples | | | |
|---|---|---|---|---|
| | A | B | D | E |
| Freeness C.S.F., ml | 130 | 100 | 35 | 300 |
| Tensile index Nm/g | 37.1 | 40.7 | [1] | 29.5 |
| Tear index, mN $m^2/g$ | 7.2 | 5.8 | [1] | 8.3 |
| Light-scattering coefficient $m^2/g$ | 42.2 | 59.0 | [1] | 38.9 |
| Opacity, % | 82.3 | 89.2 | [1] | 80.3 |
| Surface roughness, Bendtsen, ml/min | 340 | 205 | [1] | 610 |

[1]not measurable, since it was not possible to manufacture test sheets.

As the data in the Table shows, it was not possible to produce test sheets from the fine-fiber fraction (Sample D) obtained from pulp produced in accordance with the prior art. With the exception of tear index, all the properties of the long-fiber fraction obtained (Sample E) have been impaired, in comparison with those of the starting pulp (Sample A).

The pulp (Sample B) produced in accordance with the invention has very interesting properties with respect to the manufacture of printing paper. Particularly advantageous properties are the high light scattering coefficient, and the opacity of the pulp. The low surface roughness of the paper is another property of particular value when manufacturing high grade printing paper.

From Samples C and E further pulp samples were taken which were dried to a dry solids content of 92.1%. Samples were also taken from the starting pulps for respective samples (Sample C/U and Sample E/U). The dried pulps were dry shredded in a disc refiner to form a fluff intended for diaper manufacture. The properties of the samples were tested with respect to bulk and absorbency in accordance with SCAN-C 33:80, and the results are given in Table III.

TABLE III

| | Properties of the fluffed pulps Sample | | | |
|---|---|---|---|---|
| | C/U | C | E/U | E |
| Bulk, $cm^3/g$ | 18.2 | 21.3 | 14.3 | 16.0 |
| Absorption capacity, g $H_2O/g$ | 10.4 | 10.9 | 9.7 | 9.9 |
| Absorption rate, seconds | 8.1 | 8.7 | 8.2 | 8.2 |

As the data in the Table shows, pulp produced in accordance with the invention (Sample C) displays superior properties in the manufacture of fluff. Its high bulk is particularly advantageous, this bulk being the highest ever measured in this laboratory.

EXAMPLE 2

This Example illustrates application of the process of the invention in the manufacture of groundwood pulp.

Pressure groundwood pulp (PGW) was produced from spruce wood in accordance with the prior art. The pulp suspension was passed to a vibration screen, to sort out wood residues. The accepts obtained from the vibration screen was then transported to the plant described in FIG. 4.

The pulp suspension was passed to the vessel or vat 1 and then through the line 2 to the centrifugal screen 3.

The accepts from the centrifugal screen 3 was pumped through line 39 to the vortex cleaners 40.

The rejects from the screen 3 was passed via line 34 to the disc refiner 37, where the shives were worked to free the fibers. The rejects pulp was then passed through line 41 to a second stage of vortex cleaners (not shown in the Figure). The rejects from the second vortex cleaner stage was removed from the plant through line 43, while the accepts pulp was passed to the rejects refiner 37.

The accepts pulp from the first stage of vortex cleaners had a freeness of 305 ml C.S.F., and was passed through line 4 to the thickener 5. The pulp suspension was thickened in the thickener 5 to a dry solids content of 26%.

The thickened pulp was then passed to the mixer 7, and admixed with bleaching chemicals. The pulp admixed with bleaching chemicals was passed via line 8 to the bleaching tower 9. After a dwell time in the tower of about two hours, the pulp was thinned from a 26% dry solids content to a 5% dry solids content in the bottom zone of the tower, using process water charged through line 18.

The bleached and thinned pulp was passed to the vessel 11, and vigorously treated mechanically by an agitator at a temperature of 69° C. The energy input was measured at 10 kWh/ton.

After about 3 minutes, the pulp suspension was pumped through line 23 to the curved screen 19, provided with slots having a width of 2.0 mm. In order to obtain the best possible separation across the curved screen, the pumped suspension was thinned immediately downstream of the vessel to a pulp consistency of 1.1%, using process water taken from the conduits 14 and 16.

During passage through the curved screen, 45% by weight of the pulp suspension passed through the slots of the screen, and was collected on the wet machine 13. This fraction is designated the fine-fiber fraction. The remainder of the pulp, i.e. 55% of the amount of ingoing pulp, was dewatered on the wet machine 21 to a dry solids content of 48%. This fraction of the pulp is designated the long-fiber fraction. Samples were taken from the two pulp fractions, the fine-fiber fraction being designated Sample F, and the long-fiber fraction Sample G.

A further run was carried out with groundwood pulp produced in accordance with the prior art. This pulp was passed to the curved screen 19 through line 23 immediately after bleaching and thinning to a pulp consistency of 3%. Measurements showed that the amount of fine-fiber pulp obtained was only 26% of the amount of ingoing pulp. The fine-fiber fraction was analyzed, and samples thereof were designated Sample H. The long-fiber fraction was similarly analyzed, samples thereof being designated Sample K.

The results are given in Table IV.

TABLE IV

| | Sample | | | |
|---|---|---|---|---|
| | F | G | H | K |
| Starting pulp freeness C.S.F., ml | 305 | 305 | 320 | 320 |
| Sample freeness C.S.F., ml | 80 | 590 | 40 | 480 |
| Sample percentage in relation to starting pulp weight, % | 45 | 55 | 26 | 74 |
| Shives content, Sommerville, % | 0.01 | 0.28 | 0.01 | 0.29 |
| Fiber composition according to Bauer McNett | | | | |
| +20 mesh, % | 11.1 | 29.0 | 8.1 | 32.1 |
| +150 mesh, % | 54.2 | 61.2 | 29.4 | 58.7 |
| −150 mesh, % | 34.7 | 9.8 | 62.5 | 10.1 |
| Brightness, ISO, % | 80.3 | 79.7 | 80.2 | 80.0 |

The data in Table IV show that using the process of the invention it is possible to manufacture from groundwood pulp (Samples F and G) a pulp having a high long-fiber content and, at the same time, a surprisingly low fine material content (−150 mesh). The fact that it has been possible to obtain 45% by weight fine-fiber fraction from a pulp of high freeness (305 ml C.S.F.) is particularly surprising. This is to be compared with the 26% by weight obtained when fractionating the pulp immediately after bleaching (Samples H and K). The result is probably due to the fact that in the method according to the invention fiber bundles and fiber flocs are effectively and completely disintegrated prior to separating the pulp into two pulp streams.

Samples F and H were tested for papermaking properties, and the results are given in Table V.

TABLE V

| | Sample | |
|---|---|---|
| | F | H |
| Freeness C.S.F., ml | 80 | 40 |
| Tensile index Nm/g | 40.1 | 34.2 |
| Tear index, $mNm^2/g$ | 4.7 | 3.0 |
| Light-scattering coefficient $m^2/g$ | 66.3 | 66.5 |
| Opacity, % | 92.5 | 92.3 |
| Surface roughness, Bendtsen ml/min | 195 | 205 |

As the data in Table V shows, the qualities of the pulp produced in accordance with the invention (Sample F) are quite interesting with respect to the manufacture of printing paper. The high light-scattering coefficient and opacity of the pulp are particularly advantageous. The low surface roughness and high tear index of the paper are other properties of particular value in the manufacture of high grade printing paper.

Further pulp samples were taken from Samples G and K, dried, and then dry-shredded in a disc refiner, to produce fluff for the manufacture of diapers. For comparison, a pulp sample was taken from the vessel 11 (Sample L) after the bleaching. The samples were tested with regard to bulk and absorbency properties, and the results are given in Table VI.

TABLE VI

| | Properties of the fluffed pulps Sample | | |
|---|---|---|---|
| | G | K | L |
| Bulk, $cm^3/g$ | 20.0 | 19.2 | 14.7 |
| Absorption time, seconds | 7.3 | 7.8 | 7.2 |
| Absorption capacity, g $H_2O/g$ | 11.1 | 10.4 | 9.9 |

The results clearly show that the long-fiber fraction obtained in accordance with the invention (Sample G) is a splendid raw material for absorbent products. The Table shows that the properties of the starting pulp are considerably poorer than those of the long-fiber fraction.

EXAMPLE 3

A deinked paper pulp suspension was transported to a plant according to FIG. 4 from a waste-paper manufacturing plant. The pulp suspension was charged to the vessel 1. The pulp was pumped from the vessel 1 to the centrifugal screen 3 through line 2. The rejects obtained on the screen 3 was passed through line 34 to the disc refiner, where solid paper residues in the rejects pulp were disintegrated to fiber form.

The accepts obtained through the centrifugal screen was pumped through line 39 to the vortex cleaners 40; and then via line 41 to a second-stage of vortex cleaners (not shown in the Figure). The rejects from this second-stage vortex cleaners was discharged from the plant through line 43, via the separator 42, while the accepts pulp was passed to the rejects refiner through line 44.

The accepts pulp obtained from the vortex cleaners 40 had a freeness of 100 ml C.S.F., and was passed to the thickener 5 via line 4. The pulp suspension was thickened to a dry solids content of 26%. The thickened pulp was then passed through line 6 to the mixer 7, in which the pulp was admixed with bleaching chemicals.

The pulp together with the bleaching chemicals was passed via line 8 to the bleaching tower 9. After a dwell time in the tower of about two hours, the pulp was thinned from a dry solids content of 26% to a dry solids content of 5%, in the bottom zone of the tower, using process water supplied through line 18. The bleached and thinned pulp was passed through line 10 to the vessel 11.

The pulp suspension in the vessel 11 was vigorously treated mechanically by an agitator at a temperature of 73° C. The energy input was measured at 9 kWh/ton. After about 3 minutes, the pulp suspension was pumped through the conduit 23 to a curved screen 19, which was provided with slots having a width of 2.0 mm.

In order to obtain the best possible separation across the curved screen, the pulp suspension was thinned immediately downstream of the vessel to a pulp consistency of 0.9%, using process water taken from lines 14 and 16, 58% by weight of the pulp passed through the slots of the screen. The pulp suspension was passed through the conduit 24 and collected on the wet machine 13. This fraction is designated the fine-fiber fraction.

The remainder of the pulp, i.e. 42% of the amount of ingoing pulp, was passed through line 20 to the wet machine 21, and there dewatered to a dry solids content of 47%. This pulp is designated the long-fiber fraction.

Samples were taken from two pulp fractions, the fine-fiber fraction being designated Sample M, and the long-fiber fraction Sample O. The test results are shown in Table VII.

TABLE VII

| | Sample | |
|---|---|---|
| | M | O |
| Starting pulp freeness, C.S.F., ml | 100 | 100 |
| Sample freeness, C.S.F., ml | 60 | 295 |
| Amount of sample calculated in % by weight on the starting pulp | 58 | 42 |
| Shives content, Sommerville, % | 0 | 0.08 |
| Fiber composition according to Bauer McNett | | |

TABLE VII-continued

| | Sample | |
|---|---|---|
| | M | O |
| +20 mesh, % | 4.3 | 15.8 |
| +150 mesh, % | 51.3 | 70.0 |
| −150 mesh, % | 44.4 | 14.2 |
| Brightness, ISO, % | 80.3 | 79.7 |

The data show that by the process of the invention it is possible to produce from waste paper pulp a pulp having a high long-fiber content and, at the same time, a surprisingly low content of fine material (−150 mesh). The fact that it is possible to obtain 42% by weight long-fiber fraction from a pulp having a low freeness (100 ml C.S.F.) is particularly surprising.

Samples M and O were tested with regard to their paper technical properties, and the results are given in Table VIII.

TABLE VIII

| | Sample | |
|---|---|---|
| | M | O |
| Freeness, C.S.F., ml | 60 | 295 |
| Tensile index Nm/g | 33.1 | 30.0 |
| Tear index, $mNm^2/g$ | 3.1 | 4.3 |
| Light-scattering coefficient $m^2/g$ | 62.4 | 59.7 |
| Opacity, % | 91.1 | 90.0 |
| Surface roughness, Bendtsen, ml/min | 190 | 210 |

As the data in Table VIII show, the pulps produced in accordance with the invention have properties which render them quite interesting for the manufacture of printing paper, soft paper and paperboard. The high light-scattering coefficient and opacity of the pulps are also particularly advantageous. The low surface roughness and high tear index of the paper and other properties of particular value in the manufacture of high grade printing paper and paperboard.

Having regard to the foregoing disclosure, the following is claimed and the inventive and patentable embodiments thereof:

1. A process for producing high yield bleached cellulose pulp, which comprises screening and dewatering high yield cellulose pulp in such a manner that the screened pulp contains shives; bleaching the pulp; thinning the bleached pulp with process water from the dewatering to a low pulp consistency within the range from about 3 to about 7%; mechanically working the pulp to disintegrate any fiber floc present; thinning the worked pulp with process water from the dewatering to a pulp consistency within the range from about 0.3 to about 4%; and then fractionating the pulp into a fine fiber fraction comprising from about 35% to about 70% by weight of the bleached pulp and a long fiber fraction having a freeness exceeding the freeness of the fine fiber fraction by from about 150 to about 600 ml C.S.F.

2. A process according to claim 1, which comprises dewatering the fine-fiber fraction, and recycling the process water obtained in the dewatering for the thinning of the pulp prior to its fractionating, said process water containing at most 300 mg/liter fine fibers.

3. A process according to claim 1, which comprises maintaining the freeness of the fine-fiber fraction within the range from about 40 to about 175 ml C.S.F., and the fiber content so that at least 30% by weight comprises fibers which pass through a 150 mesh wire screen in a Bauer McNett fiber classifier.

4. A process according to claim 1 which comprises maintaining the freeness of the long-fiber fraction within the range from about 200 to about 750 ml C.S.F., and the fiber content so that from about 85 to 100% by weight comprises fibers retained on a 150 mesh wire screen in a Bauer McNett fiber classifier.

5. A process according to claim 1 which comprises:

(1) screening the worked and thinned pulp through a screen having slots with a width not exceeding 2 mm;

(2) collecting and dewatering a portion of the screened pulp as a fine fiber fraction;

(3) collecting and dewatering the remaining portion not exceeding 60% of the worked and thinned pulp as a long fiber fraction.

6. A process according to claim 5 in which the high yield bleached pulp starting material is groundwood pulp.

7. A process according to claim 5 in which the pulp is pulp refined in a disc refiner.

* * * * *